United States Patent [19]

DeLorean

[11] 4,378,658

[45] Apr. 5, 1983

[54] MOUNTING FOR A VEHICLE DOOR

[75] Inventor: John Z. DeLorean, New York, N.Y.

[73] Assignee: Delorean Research Limited Partnership, Bloomfield Hills, Mich.

[21] Appl. No.: 231,398

[22] Filed: Feb. 4, 1981

[51] Int. Cl.[3] ..... E05F 1/00

[52] U.S. Cl. ..... 49/379; 16/308; 49/386; 267/154

[58] Field of Search ..... 49/386, 379; 16/308; 267/154, 155; 296/146, 151, 185, 31 P

[56] References Cited

U.S. PATENT DOCUMENTS

| | | | |
|---|---|---|---|
| 2,197,950 | 4/1940 | Schwenk | 296/151 X |
| 2,567,287 | 9/1951 | Ingram | 16/308 X |
| 2,876,037 | 3/1959 | Ingolia et al. | 296/31 P X |
| 2,903,296 | 9/1959 | Barenyi | 296/146 |
| 3,067,453 | 12/1962 | Lyons | 267/154 X |
| 3,490,756 | 1/1970 | Spier | 49/386 X |
| 3,511,530 | 5/1970 | Barenyi | 296/146 |
| 4,017,117 | 4/1977 | Eggert, Jr. | 296/146 |
| 4,092,180 | 5/1978 | Markow et al. | 148/125 |

*Primary Examiner*—Philip C. Kannan

*Attorney, Agent, or Firm*—Kenyon & Kenyon

[57] ABSTRACT

A door is mounted to hinge about a horizontal axis between a closed position and an open position. A torsion bar is mounted in pretensioned manner to bias the door from the closed position to the open position and to hold the door in the open position in a tensioned manner. The vehicle body is made of molded reinforced plastic while the hinges and mounting plates are metal.

8 Claims, 4 Drawing Figures

MOUNTING FOR A VEHICLE DOOR

This invention relates to a mounting for a vehicle door.

As is known, the doors for vehicles, such as automobiles and trucks, have been mounted in many cases to rotate about vertical axes between an open and a closed position. In addition, the doors have been mounted so that detents, bars or the like can be used to hold the doors in the open position. In these cases, a manual effort has usually been required to move the doors from the open position to the closed position.

Various types of vehicles, such as sports cars and racing cars, have also been known wherein doors are mounted to move about an axis other than a vertical axis. For example, it has been known to mount the doors to pivot about a horizontal axis between an open and closed position. In these cases, it has been known to use various linkages and the like to hold the doors in the open condition. However, some manual effort has usually been required in order to move the doors from a closed position to an open position. In such cases, it has been cumbersome to open the doors while exiting from the vehicle.

Accordingly, it is an object of the invention to provide a door mounting for a vehicle which allows a door to be pivoted about a horizontal axis from a closed position automatically into an open position upon release.

It is another object of the invention to provide a mounting for biasing a door into an open position from a closed position.

It is another object of the invention to provide a mounting for biasing a door into an open position while maintaining the door in the open position.

It is another object of the invention to provide a vehicle door mounting which facilitates opening of the door in order to aid egress from the vehicle.

Briefly, the invention provides a mounting for a vehicle door which is comprised of a means for mounting the door for movement between a closed position and open position and a cryogenic torsion bar for biasing the door from the closed position towards the open position. In addition, the torsion bar is pretensioned in order to hold the door in the open position.

The means for mounting the door includes a pair of hinges which are disposed on a common hinge axis. In this case, the torsion bar is coaxial with the hinge axis at one end and is offset from the hinge axis at the opposite end. For example, one of the hinges includes a socket receiving one end of the torsion bar in non-rotatable manner so that the torsion bar is coaxial with the hinge axis at that end. Thus, upon movement of the door about the hinge axis towards the closed position, the torsion bar is twisted so as to have a stress imparted thereto for biasing the door towards the open position.

The mounting is particularly useful in combination with a vehicle body, made for example, of a molded fiber reinforced plastic. In this case, a plurality of metal mounting members are secured to the vehicle body to accept metal hinges for the mounting of the door. These metal mounting members can be secured to the molded plastic body in any suitable manner.

The use of the torsion bar for biasing the door into the open position eliminates the need for any coil springs or spring mountings. In this way, the door mounting is of compact construction. In addition, the torsion bar may be located below the plane of the hinge axis so as to lie below the plane of the door. In this way, the torsion bar can be positioned in an aesthetic manner out of view when the door is closed.

By mounting the free end of the torsion bar in a metal mounting member, which, in turn, is secured to the molded body, the pre-stress which is imposed in the torsion bar can be accommodated by the metal mounting member rather than by the molded plastic body. Thus, should the door and mounting member become damaged in a manner which requires replacement, the door and metal mounting member can be readily removed from the molded plastic body. Further, any damaging stresses which may be imposed via the torsion bar may be more readily absorbed by the metal mounting member rather than the molded plastic body.

These and other objects and advantages of the invention will become more apparent from the following detailed description taken in conjunction with the accompanying drawings wherein.

Figure 1:
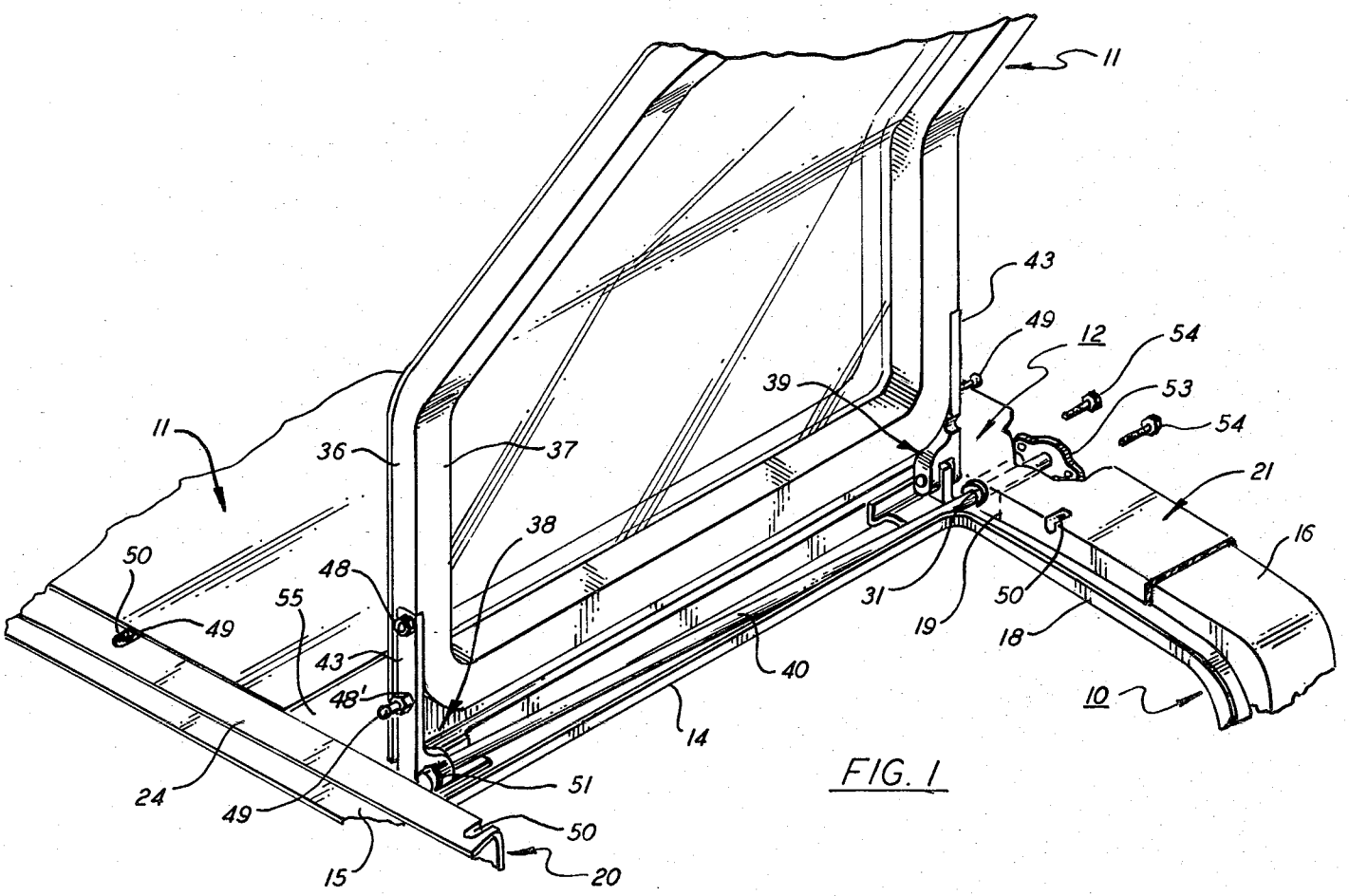
FIG. 1 illustrates a perspective view of a door mounted on a vehicle body of molded plastic construction in accordance with the invention.

Referring to FIG. 1, a vehicle such as an automobile is provided with a molded vehicle body 10, for example made of a glass fiber reinforced plastic, a pair of doors 11, a means 12 for mounting each door 11 for movement on a pivot axis between a closed position and an open position and a plurality of metal mounting members 13 which are secured to the molded body 10 for receiving the mounting means 12.

Figure 4:
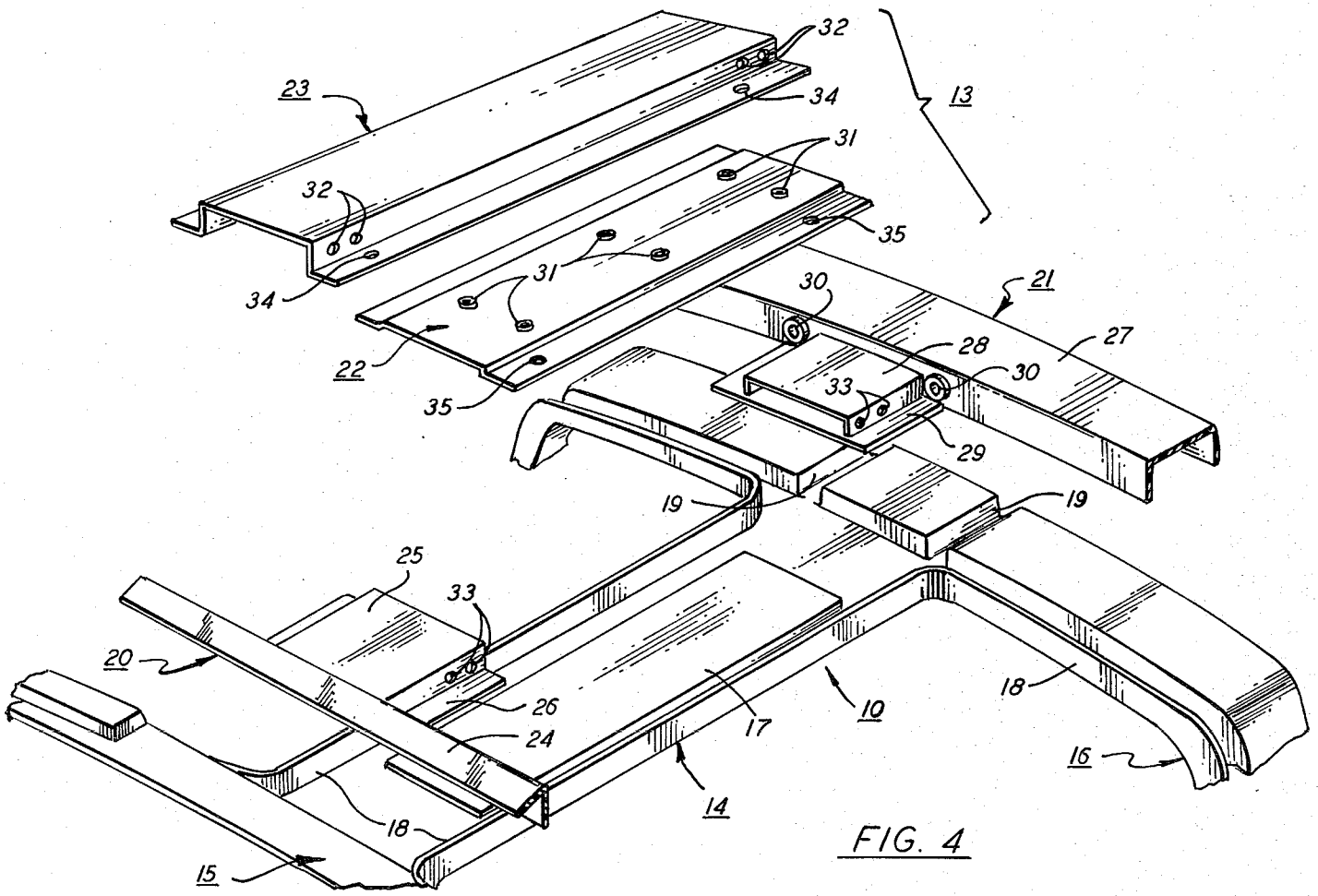
FIG. 4 illustrates an exploded view of a part of a molded plastic vehicle body and various metal mounting members for receiving a door mounting in accordance with the invention.

As indicated in FIGS. 1 and 4, the molded vehicle body 10 has a skeletal frame which includes a longitudinally disposed channel shaped beam 14 and a pair of cross beams 15, 16 at the roof of the vehicle. These beams 14, 15, 16 are molded in a unitary manner with the remainder of the vehicle body 10 (not shown) in any suitable manner and define a pair of openings over which the doors 11 fit. The longitudinal beam 14 has a raised central portion 17 and two upstanding walls which define lips 18 which extend along the beam 14 and merge into a similar upstanding wall or lip 18 on the cross beams 15, 16. The lips 18 serve to form an abutment against which the doors 11 can seal when in a closed position as described below. The rearmost cross-beam 16 includes a pair of recesses 19 which are aligned with the plane of the longitudinal beam 14 for purposes as described below.

Referring to FIG. 4, the metal mounting members 13 include cover plates 20, 21 for fitting over the cross-beams 15, 16, a cover plate 22 for fitting into the cross-beam 14 and a mounting plate 23.

As indicated, the cover plate 20 includes an angle 24 which fits along and is secured, as by bolts (not shown) to one side of the cross-beam 15 and an inverted U-shaped member 25 which extends perpendicularly of the angle 24 into the longitudinal beam 14. This member 25 is secured in fixed manner to the angle 24, for example by welding. A plate 26 is also secured, as by welding, to the bottom of the U-shaped member 25 to form a short box beam.

The cover plate 21 is constructed of a channel shaped member 27 which fits over the horizontal cross-beam 16, a U-shaped member 28 which extends perpendicularly from the channel shaped member 27 in an integral manner into the beam 14 and a plate 29 which is secured, as by welding, to the bottom of the U-shaped member 28. The plates 26, 29 are also sized to fit into the interior of the longitudinal beam 14. The channel shaped member 27 is provided with apertures 30 for purposes as explained below and is otherwise secured in suitable fashion to the body 10.

The cover plate 22 is provided with a plurality of apertures 31 to receive bolts (not shown) for bolting of the plate 22 to the longitudinal beam 14. To this end, suitable openings are provided in the longitudinal beam 14 to receive the bolts.

The mounting plate 23 is of generally inverted U-shape and is of such a length and width to fit over the U-shaped members 25, 28 of the cover plates 20, 21 and over the cover plate 22. As indicated, suitable bolt holes 32 are provided in the sidewalls of the plate 23 for alignment with bolt holes 33 in the U-shaped members 25, 28, respectively. Likewise, bolt holes 34 are provided in the edges of the plate 23 for alignment with bolt holes 35 in the cover plate 22.

Referring to FIG. 1, each door 11 is constructed of any suitable shape to fit over a respective opening in the vehicle body 10. As indicated, each door 11 has a flat horizontally disposed lip 36 which extends about the periphery of the door 11 as well as a well-like body 37 which is sized to fit within an opening of the body 10 with the lip 36 resting on a lip 18 formed by the beams 14, 15, 16 in a sealed manner.

Referring to FIG. 1, each mounting means 12 is in the form of a pair of hinges 38, 39 for mounting a door 11 on the vehicle body 10 for movement between a closed position on the vehicle body 10 and an open position, as viewed in FIG. 1. In addition, each mounting 12 includes a torsion bar 40 for biasing a door 11 from the closed position towards the open position.

Figure 2:
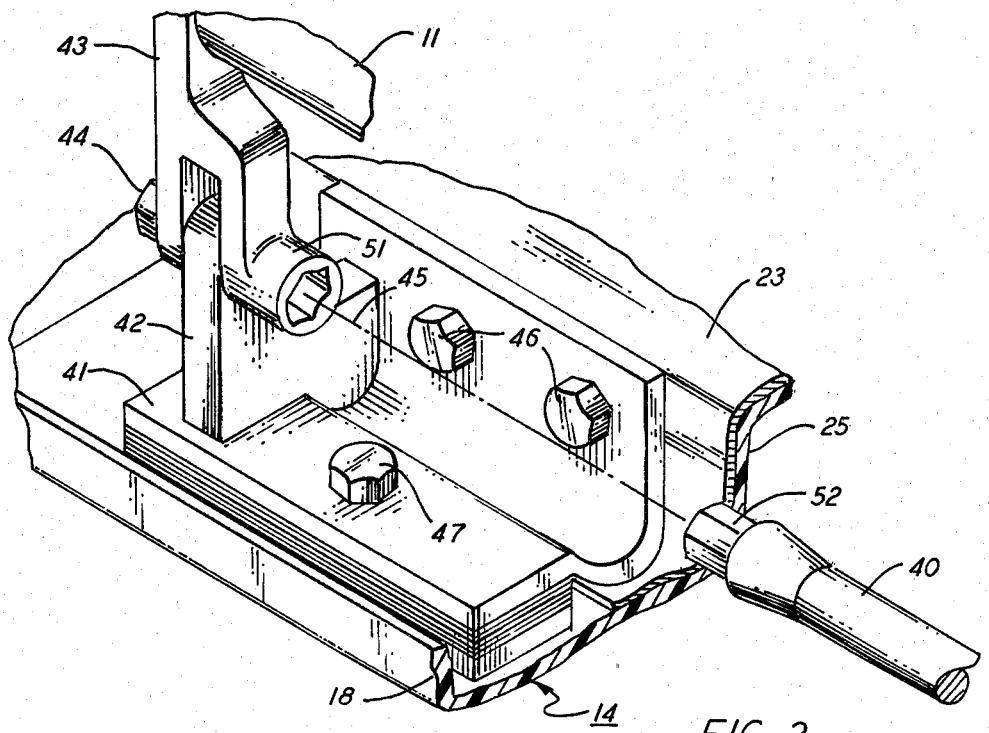
FIG. 2 illustrates a perspective view of a hinge of the mounting for receiving a torsion bar in accordance with the invention.

As shown in FIG. 2, one hinge 38 includes a mounting plate 41, for example of metal, which is of substantially L-shape, an upstanding support 42 which is integral with the plate 41, a bifurcated hinge plate 43 which is secured to the door 11 and a pin 44 which is mounted on a horizontal hinge axis 45 to secure the hinge plate 43 to the support 42. The mounting plate 41 is secured by bolts 46 to the sidewalls of the mounting plate 23 via the apertures 32 (not shown) and by a bolt 47 to the cover plate 22 via the aperture 34 (not shown). The bolt 47 also passes through a suitable opening in the base of the beam 14. If required, suitable shim plates may be positioned between the mounting plate 41 and the cover plate 22.

The support 42 is apertured to receive the pin 44. Likewise the bifurcated end of the hinge plate 43 is provided with suitable apertures to receive the pin 44. The hinge plate 43 is also bolted in suitable manner to the door 11 via bolts 48, 48' as shown in FIG. 1. As indicated, one of the bolts 48' has a projecting head 49 which acts as a stop for the door 11. To this end, the head 49 is received in a suitable recessed slot 50 formed in the angle 23 of the cover plate 20 when the door is closed.

The hinge 39 is constructed in like manner and similar reference characters have been used to indicate similar parts.

Referring to FIG. 2, the hinge 38 also has a socket 51 at one end of the pin 44 in order to receive one end 52 of the torsion bar 40 in non-rotatable manner. To this end, the end 52 of the torsion bar 40 is shaped to mate within the socket 51.

Figure 3:
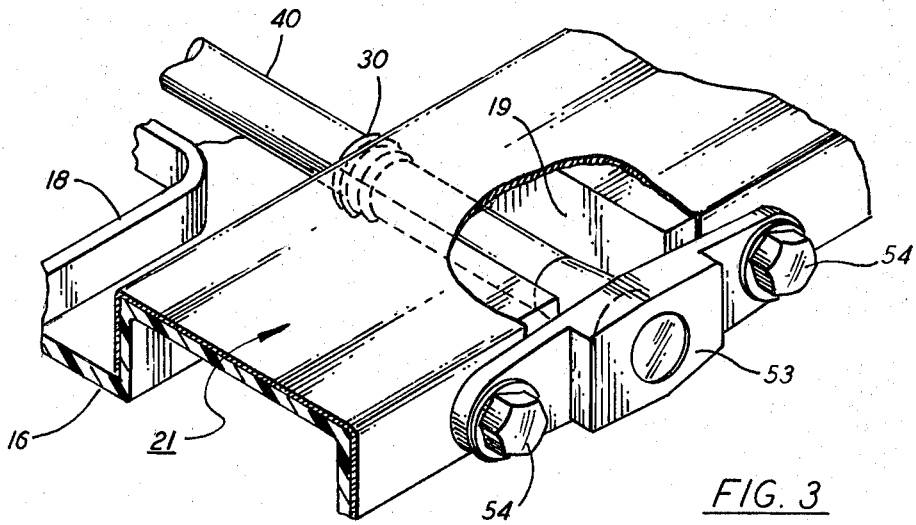
FIG. 3 illustrates a perspective view of the free end of the torsion bar mounted in a metal mounting member in accordance with the invention.

Referring to FIG. 3, the opposite end of the torsion bar 40 passes through an aperture 30 in the cover plate 21 and a recess 19 in the cross-beam 16 and is secured to the cover plate 21 in a pretensioned manner. As indicated, the end of the torsion bar 40 is fixedly received in a bracket 53 which, in turn, is bolted via two bolts 54 to the channel shaped member 27 of the cover plate 21. With the door 11 in the open position the bracket 53 is rotated clockwise, as viewed, over an angle of, for example about 20°, and thereafter secured to the member 27 so as to pretension the torsion bar 40. The fixation of the torsion bar to the metal member 27 allows the stresses imposed on the torsion bar to be transmitted to the metal member 27 rather than directly to the cross beam 16 of the molded body 10.

The torsion bar 40 is made of any suitable material, such as a cryogenic material as described in U.S. Pat. No. 4,092,180.

In order to mount a door 11 on the vehicle body 10, the various plates 20, 21, 22, 23 are first secured to the body 10. For example, the plates 20, 21 are bolted to the cross-beams 15, 16 via suitable bolts and bolt holes. Thereafter, the plate 22 is bolted over the raised portion of the longitudinal beam 14. Next, the plate 23 is placed over the members 25, 23 with the bolt holes 34 aligned with the apertures 35 in the plate 22.

Thereafter, the hinge plates 41 of the hinges 38, 39 are aligned with the bolt holes 32 and secured via the bolts 46 to the plate 23 and via the bolt 47 to the plate 22 and the beam 14.

Next, the door 11 provided with the hinge plates 43 is located so that the bifurcated ends of the hinge plates 43 are aligned with the supports 42 and the pins 44 inserted to secure the hinge plates 43 to the supports 42. At this time, the door 11 is mounted in a pivotal relation about the horizontally disposed pivot axis 45 for movement between the closed position and the open position.

Thereafter, the torsion bar 40 is inserted through the openings in the channel-shaped member 27 and the aligned recess 19 in the cross beam 16 (in spaced relation) and the end 52 inserted into the socket 51. Next, with the door 11 in the open position as shown in FIG. 1, the bracket 53 (FIG. 3) is twisted over an angle of for example 20° (clockwise as viewed in FIG. 3) to twist the torsion bar 40. The bracket 53 is then secured to the member 27 via the bolts 54. Thus, the pre-tension which is imparted to the torsion bar 40 maintains the door 11 in the open position.

The door 11 can then be pivoted into the closed position manually. During this time, the torsion bar 40 is further twisted. Thus, when the door 11 is released from the closed position, e.g. via a suitable release mechanism, the door 11 is able to pivot automatically directly into the open position shown in FIG. 1.

When a door 11 is in the closed position, the lip 36 rests on the lip 18 of the molded body 10 in a sealed manner. In addition, the well-like body 37 of the door 11 is recessed within the lip 18. The longitudinal edge of each door 11 is also provided with a suitable sealing strip (not shown) for fitting under and against a suitable cover plate 55 which is secured across the top of the plate 23. This plate 55 may be secured in any suitable fashion to the vehicle body 10 so as to present a smooth flush appearance with the doors 11 when the doors 11 are in a closed position.

The invention thus provides a mounting for a door which not only provides for the automatic biasing of the door frame into an opened position so as to facilitate egress from within the vehicle also maintains the door in the opened position.

Since the door is mounted on a horizontal axis, the automatic opening of the door allows ready access to and from the vehicle, particularly where the vehicle has a low profile.

The mounting is of relatively simple construction and can be readily mounted in place. Further, the mounting, if damaged, can be readily removed from the vehicle and replaced. Still further, the torsion bar allows the use of simple tools for assembly of the door.

What is claimed is:

1. In combination:

a vehicle body;

a door;

a pair of hinges disposed on a common hinge axis, for mounting said door on said vehicle body for movement between a closed position and an open position, each hinge having a mounting plate, a hinge plate and a pin mounted on said axis and in said mounting plate with said hinge plate pivoted thereon;

means securing said mounting plate to said vehicle body;

at least one bolt securing each respective hinge plate to said door frame, said bolt having a projecting head for abutting said vehicle in a recessed manner in a closed position of said door; and a torsion bar having one end secured to said door and another end secured to said vehicle body biasing said door toward said open position.

2. The combination as set forth in claim 1 wherein said hinge plate of one of said hinges includes a socket receiving one end of said torsion bar in non-rotatable manner whereby upon movement of said door towards said closed position said torsion bar is twisted.

3. The combination as set forth in claim 2 wherein said torsion bar is coaxial with said hinge axis at said one end and offset from said axis at an opposite end.

4. The combination as set forth in claim 2 wherein said torsion bar is fixedly secured at an end opposite said one end.

5. The combination as set forth in claim 1 wherein said torsion bar is a cryogenic torsion bar.

6. The combination as set forth in claim 1 wherein said body is made of glass fiber reinforced plastic.

7. The combination as set forth in claim 1 wherein said hinge axis is horizontal.

8. The combination as set forth in claim 1 wherein said torsion bar is pre-tensioned to hold said door in said open position.

* * * * *